United States Patent [19]

Fowler

[11] Patent Number: 4,807,552

[45] Date of Patent: Feb. 28, 1989

[54] SMALL BOAT BOW THRUSTER

[76] Inventor: Larrie M. Fowler, 120 LeMaister Ave., Wenatchee, Wash. 98801

[21] Appl. No.: 182,897

[22] Filed: Apr. 11, 1988

Related U.S. Application Data

[63] Continuation-in-part of Ser. No. 933,244, Nov. 21, 1986.

[51] Int. Cl.[4] ..... B63H 25/46

[52] U.S. Cl. ..... 114/151; 440/38

[58] Field of Search ..... 114/151; 440/38, 39, 440/11; 48/166, 171, 15

[56] References Cited

U.S. PATENT DOCUMENTS

| | | | |
|---|---|---|---|
| 2,330,674 | 9/1943 | Briggs | 114/151 |
| 3,078,661 | 2/1963 | Spence | 114/151 |
| 4,056,073 | 11/1977 | Dashew et al. | 114/151 |
| 4,367,638 | 1/1983 | Gray | 418/166 |

*Primary Examiner*—Joseph F. Peters, Jr.

*Assistant Examiner*—Edwin L. Swinehart

*Attorney, Agent, or Firm*—Mark Zovko

[57] ABSTRACT

A small boat bow thruster which includes a port and starboard discharge nozzle forwardly mounted through the hull of the boat above the water line. Water from an inlet port located below the water line of the boat is drawn by a pump through conduits to the discharge nozzles. The pump is a bi-directional positive displacement pump which can feed either the starboard or port discharge nozzle depending on the direction of pump rotor rotation. The pump is powered by an electric motor capable of running in a normal or reversed mode and which is controlled by an activation switch manually operated. Water is discharged through the port or starboard nozzle above the water line of the boat when the system is activated. The bow is thrust sidewise in the direction opposite of the nozzle discharge allowing slow and controlled maneuvering of the boat in tight spaces.

2 Claims, 2 Drawing Sheets

12
14
16
15
32
36
4
26
10
30
34
28
20
18
22
24
27
2

SMALL BOAT BOW THRUSTER

CROSS RELATION TO OTHER APPLICATION

This application is a continuation-in-part of my copending application Ser. No. 933,244 filed 11/21/86 entitled Small Boat Bow Thruster.

BACKGROUND OF THE INVENTION

1. Field of the Invention

This disclosure relates in general to an improved maneuvering system for small boats, and more particularly to a bow thruster for small boats which greatly facilitates operations done at slow speeds such as docking in congested area.

2. Discussion of the Prior Art

The increased congestion present in many docking areas for small boats has created a problem for the boat operators. Small boats are usually maneuvered by the propulsion system located in the rear of the boat. Either a steerable outboard engine or rudder pivoted to one direction or the other with a consequent movement of the bow of the boat to the opposite side. In small, cramped spaces maneuvering the boat is difficult at best even for many skilled operators, and many accidents such as ramming another vessel or the dock occur. The problem of maneuverability exists because the bow of the boat responds only to the engine or rudder in the rear. The present invention provides an auxiliary maneuvering system which enables the operator to steer the bow of the boat as well as the stern, making the boat much more maneuverable. In the past, apparatus for steering the bow of a small boat that the applicant has been have had many limitations. Such steering devices include those requiring the cutting of large holes through the bow of the boat to install a large propeller in a tube transverse to the bow of the vessel. Such units have difficult hull installation and require substantial hull repair after installation. Further, the large transverse tunnel with the propeller enclosed creates a water trap which in turn increases the flow drag on the boat hull, making the vessel more difficult to propel through the water. The speed of the boat, therefore, is lowered and fuel consumption increased. The present invention uses only small diameter inlet and outlet fittings through the hull and therefore avoids many of the above-mentioned problems.

A preliminary search of the prior art was performed by applicant and the following patents were found to be of possible interest:

| U.S. Pat. No. | ISSUE DATE | INVENTOR |
|---|---|---|
| 917,201 | 4/6/09 | Vollmer |
| 961,306 | 6/14/10 | Mayell |
| 1,240,932 | 9/25/17 | Brown et al |
| 3,078,661 | 2/26/63 | Spence |
| 4,056,973 | 11/1/77 | Dashew et al |
| 4,214,544 | 7/29/80 | Dashew et al |
| 4,265,192 | 5/5/81 | Dunn |

In the patents discovered by the search, the first three, namely Vollmer, Mayall, and Brown et al, have various propelling and steering apparatus which discharge water below the water line of the boat which is not what applicant does, and in fact, would not work for his application. Spence shows nozzles which discharge to the rear of the boat unlike applicant's apparatus although they do discharge above the water line.

The two Dashew et al patents and the Dunn patent show discharge of water above the water line in the bow of the boat as does applicant. The present invention, however, differs significantly from these inventions which require control valves and a relatively complicated arrangement of conduits to perform. Applicant's invention does not require control valves, and does not require a bypass conduit such as Dunn requires while the water pump is operating, but before maneuvering is to occur. Applicant's system is controlled simply by an activation switch which can turn the water pump on in a normal or reversed mode or turn the pump off. The direction of bow thrust is controlled by this switch. The present invention has the advantage of being simple, easier to install and less expensive than the system of Dunn or Dashew et al.

It should be noted that a further possible reference is Dornak (U.S. Pat. No. 3,933,113). Dornak's apparatus functions in a different manner than applicant's apparatus. The rotation of Dornak's apparatus is rotation of his *nozzle* 23, not his pump. The nozzle 23 could be rotated to a different discharge position. The present invention does not rotate any nozzle or the direction of nozzle discharge. If Dornak's pump 32 were reversed, the flow of water would be from the nozzle 23 to an exit in the bottom of the hull producing no directional change as the present invention can by a reversal of pump rotational direction. In other words, reversing Dornak's pump would make his entire system inoperable. Further, it would not be obvious given Dornak how to reverse his pump and produce directional change successfully as does the present invention due to the difference in function and structure of his apparatus vis-a-vis the present invention. Further, the present invention claims at least two rotors in addition to the above arguments which distinguish the present invention from Dornak.

Further comments can be made regarding Dashew et al (U.S. Pat. No. 4,056,073) which was cited in the parent case. Firstly, valve 44 is a directional control valve used by Dashew et al. applicant's desire from a functional and economic standpoint was to use a simple apparatus to achieve maneuvering in tight spaces without using a valve as does Dashew et al. The present invention has no directional valves, nor would desire any valves due to complexity and economic considerations. The two rotors of the pump of the present invention in a unique way, given the prior art, perform the directional changes required, *taking* the place of a valve 44 as shown in Dashew et al. The use of the pump with its rotors as in the present invention would not be obvious given Dashew et al who shows only a valve to change direction. The valve may obtain a result of maneuvering the boat, but is different structurally vis-a-vis the present application. This structural difference is a key difference and in this difference lies the heart of the present invention. Further, Dashew et al does not go as far as to render the present invention obvious. The valve 44 is too much different than the use of two rotors in a pump to achieve directional control. The present invention can eliminate the use of directional valving with its apparatus. This factor should show that this invention differs enough from Dashew et al as to render it patentable over Dashew et al.

SUMMARY OF THE INVENTION

The present invention provides apparatus for maneuvering a boat in tight spaces by allowing the pilot the capability of moving the bow of the boat by means independent of the boat's engine. Thrusting the bow to either side in a controlled manner is accomplished by the following apparatus. A bow starboard side nozzle located in the hull of the boat above the water line is provided, as is a corresponding bow port side nozzle also located above the water line. An inlet port is located in the boat hull below the water line and provides an inlet for water drawn by a positive displacement bi-directional water pump. The water pump is connected between the inlet port and the starboard side and port side outlet nozzles. The water pump has an inner and outer rotor as described in detail subsequently. Rotation of these rotors in one direction produces water flow from the inlet port through the starboard side outlet nozzle allowing the bow to be thrust to the port side, while rotation of the rotors in the other direction produces a water flow from the inlet port through the port side nozzle allowing the bow to be thrust to the starboard side. The port and starboard nozzle exit from the boat hull above the water line and impinge on the surrounding water. This force caused by the impinging stream of water allows the maneuvering of the boat to occur. The water pump is powered by an electric motor connected thereto which is capable of running in a normal or reversed mode. The modes of the electric motor determine the direction of rotor rotation of the water pump and thus the direction of the bow thrust. An activating switch is provided for the electric motor which can activate the electric motor in a normal or reversed mode. The maneuvering of the boat hull can be controlled ultimately by the pilot's use of the activation switch.

It is therefore an object of the present invention to provide an apparatus for maneuvering a boat in small, tight spaces such as near a dock which is relatively simple and easy to use.

Another object of the present invention is to provide apparatus for maneuvering a boat in small, tight spaces which is easy to install on already existing boats.

A further object of the present invention is to provide a bow thruster for a boat which is relatively inexpensive and substantially increases the ability of the boat's maneuverability in small, tight spaces.

Yet another object of the present invention is to provide apparatus for maneuvering a boat in small spaces which doesn't require a large aperture in the boat's hull.

Still another object of the present invention is to provide apparatus for maneuvering a boat in small spaces which doesn't require the additional complication of directional control valves.

These and other objects and advantages of the present invention will become more apparent from the following detailed description when taken in conjunction with the attached drawings.

DETAILED DESCRIPTION OF THE PREFERRED EMBODIMENT

Figures 1, 2:
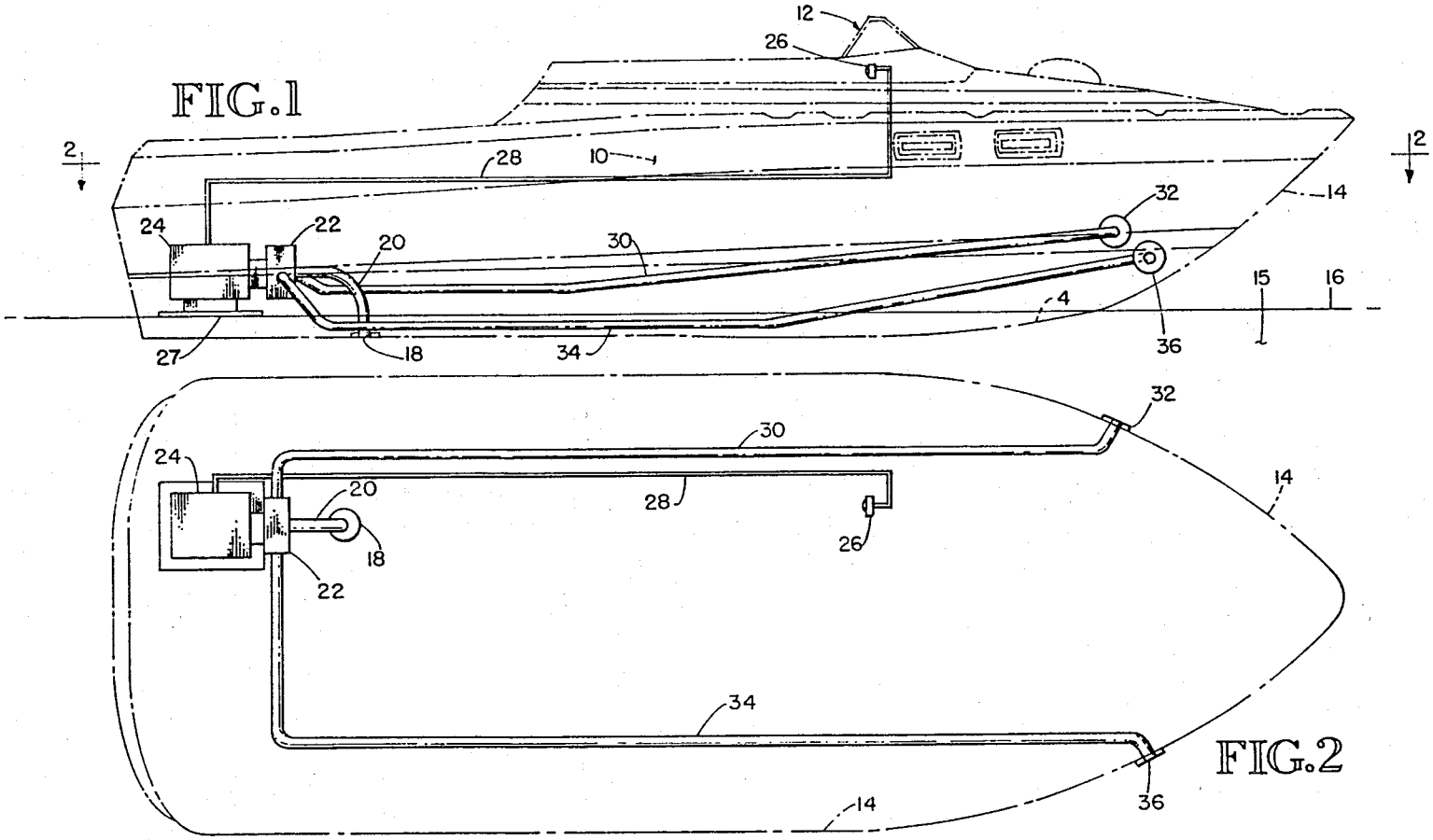
FIG. 1 is a diagrammatic vertical longitudinal section through a small boat equipped with the bow thruster of the present invention.
FIG. 2 is a diagrammatic top plan view in section taken along line 2—2 of FIG. 1.

Referring to FIGS. 1 and 2, the bow thruster of the present invention can be described in detail. FIG. 1 shows a bow thruster of the present invention generally designated as 10 within a small boat 12 in a preferred embodiment. The hull 14 of the boat 12 is submerged in a body of water 15 having a water line 16. Within hull 14 is located the bow thruster 10. Bow thruster 10 comprises a through the hull suction inlet 18 located below the water line 16 and directly communicating with the body of water 15. Inlet 18 is connected through suction line 20 to the positive displacement bi-directional pump generally designated as 22 and described in further detail in FIGS. 3 and 4. Pump 22 is directly connected to a reversing electric motor 24 which can drive pump 22 in a clockwise or counterclockwise direction depending on the choice of the boat operator. The motor 24 can be suitably mounted to a base 27 located in hull 14. As shown in FIG. 1, the pump 22 and motor 24 can be mounted in the aft (rearward) end of the boat 12. A reversing switch 26 is connected through a two conductor wire 28 to electric motor 24. The reversing switch 26 would preferably be located in a convenient location on the instrument panel (not shown) of the boat 12. Connected to the pump 22 is a port side pressure line 30 which terminates in a port side high pressure nozzle 32. Also connected to the pump 22 is a starboard side high pressure line 34 opposite the port side pressure line 30 terminating in the fore of the boat 12 in a starboard side high pressure nozzle 36. Both port and starboard nozzles 32 and 36 are located outside of the hull 14 above the water line 16 and are generally directed outwardly and downwardly toward the water 15.

Figure 4:
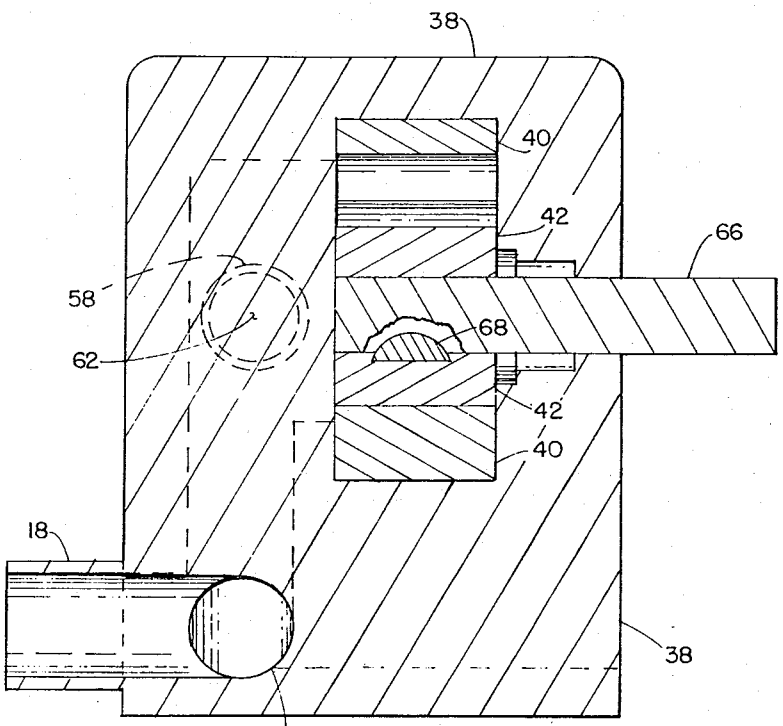
FIG. 4 is a diagrammatic vertical partial sectional view of the pump of FIG. 3 taken along line 4—4 of FIG. 3.
Figure 3:
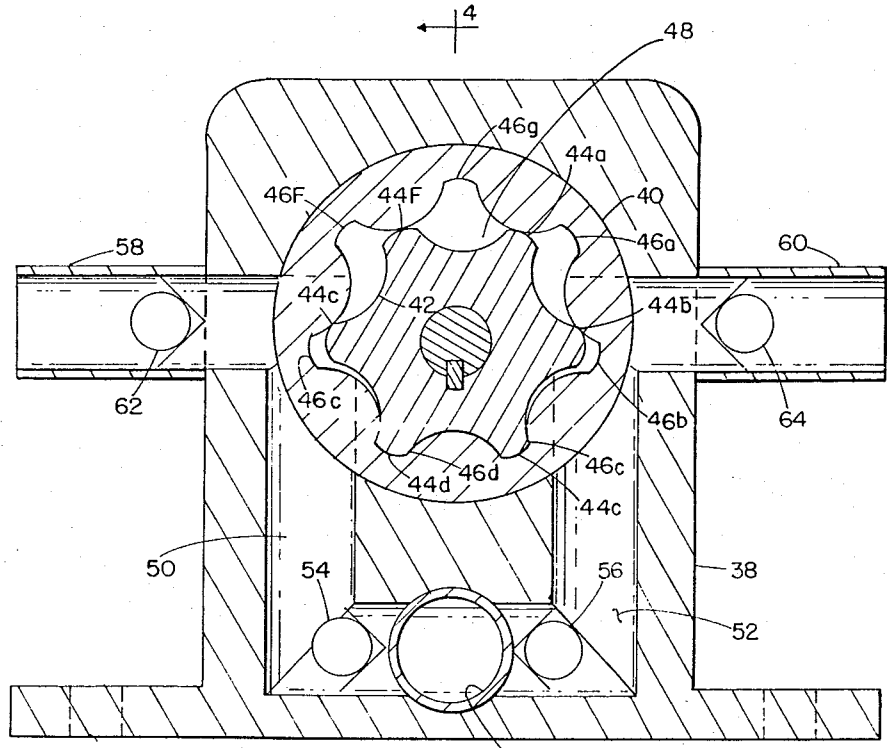
FIG. 3 is a diagrammatic vertical sectional view of a positive displacement bi-directional water pump used in the present invention.

Referring to FIGS. 3 and 4, the positive displacement bi-directional pump 22 can be described in further detail. The advantage of the pump 22 with respect to prior art systems is that the use of pump 22 eliminates the need for directional control valves and any by-pass lines that are required after a conventional pump is started but before the system is called upon to maneuver the boat. Installation is simplified and more economically feasible for the small boat owner. Pump 22 has a pump body 38 which contains an outer rotor 40 and an inner rotor 42. The axis of rotation of the inner rotor 40 is slightly offset from the axis of rotation of rotor 42, typically about ⅛th inch for the present application. The inner rotor 42 has a series of protrusions 44*a* through *f*. The outer rotor has a series of indentations 46*a* through *g*. A plenum 48 is defined by the space between the inner rotor 42 and outer rotor 40. The plenum 48 communicates with inlet 18 through conduits 50 and 52. Conduit 50 has a check valve 54 located directly upstream of the inlet 18 and similarly conduit 52 has a check valve 56 located upstream of inlet 18. The conduits 50 and 52 directly communicate with the plenum 48 formed by the inner rotor 42 and outer rotor 40. The pump 22 also has a pair of outlet ports 58 and 60 which contain check valves 62 and 64 respectively. The outlet ports 58 and 60 connect directly to the port and starboard high pressure lines 30 and 34 (FIG. 2). A drive shaft 66 (FIG. 4) from the electric motor 24 is keyed by key 68 to the inner rotor 42. The inner rotor 42 will then rotate in the direction that drive shaft 66 of electric motor 24 is rotating as determined by the operator through the use of switch 26. Switch 26 can either be in an off position, in a position resulting in clockwise rotation of drive shaft 66 of electric motor 24, or in a position resulting in counter-clockwise rotation of driveshaft 66 of electric motor 24. As inner rotor 42 begins to rotate the protrusions 44*a* through *f*, and especially 44*c* and 44*d* as shown in FIG. 3 partially mesh with the indentations 46*a* through *g* and especially 46*c* and 46*d* to move outer rotor 40 in the same direction as inner rotor 42 forcing an amount of water from inlet port 18 into plenum 48 and through outlet port 58 or 60 (depending on the direction of rotation of rotors 40 and 42).

Referring to FIGS. 3 and 4, the operation of pump 22 can be described. In general the pump 22 depending upon the direction of rotation of rotors 40 and 42, will direct water from inlet 18 to either the port or starboard high pressure lines 30 or 34 and ultimately through either the port or starboard high pressure discharge nozzles 32 or 36. Water flow is allowed through only one of lines 30 or 34 and stopped through the other depending on the direction of rotation of rotors 40 and 42. For example, if drive shaft 66, outer rotor 40, and inner rotor 42 are rotating clockwise, water is drawn through inlet 18 past check valve 54, through conduit 50, into plenum 48, past check valve 64, and through outlet port 60 to either the port or starboard high pressure nozzle 32 or 36. Water flow into conduit 52 is prevented by check valve 56, and water flow from outlet port 58 is prevented by check valve 62. If the rotors 40 and 42 of pump 22 are rotating counterclockwise, the opposite flow occurs. Water flows from inlet 18, past check valve 56, through conduit 52, into plenum 48, past check valve 62 and through outlet port 58. Check valves 54 and 64 prevent water flow from inlet 18, through conduit 50 and outlet port 60. The direction of rotation of rotors 40 and 42 can be determined by reversing the driveshaft 66 of electric motor 24 and controlled by the operator from reversing switch 26. Reversing switch 26 can, therefore, determine whether the water flow from inlet 18 will be directed to the port high pressure nozzle 32 or starboard high pressure nozzle 36 which in turn determines the direction in which the boat 12 will be maneuvered. This maneuvering can be accomplished with a relatively simple scheme requiring no directional control valves.

Given the above discussion, operation of the system can be described. The operator will choose which direction the bow of the boat 12 will be thrust to, and cause a discharge through the opposite high pressure discharge nozzle 32 or 36 by using switch 26. For example, if the bow of boat 12 is desired to be directed to the port side, the operator will use switch 26 to cause a flow of water from inlet 18, through pump 22 to the starboard high pressure line 34 and out starboard side high pressure nozzle 36. The water will discharge from nozzle 36 and impinge upon the body of water 15 controllably maneuvering the bow of the boat 12 toward the port side. Of course, to maneuver the bow of boat 12 to the starboard side, the discharge of water would be directed to occur out of port side nozzle 32 by switching the switch 26 to the appropriate position. Pump 22 will be caused by motor 24 to rotate the rotors 40 and 42 in the opposite direction as the first example and cause a movement of the bow toward the starboard side.

The invention has been disclosed using the above described embodiment of pump 22. It should be noted that pump 22 as described is a preferred embodiment, but other pumps known in the art as rotary gear pumps could be substituted for pump 22 with suitable results.

The invention may be embodied in other forms without departing from the spirit or essential characteristics thereof. The present embodiments are therefore to be considered in all respects as illustrative and not restrictive, the scope of the invention being indicated by the appended claims rather than the foregoing description, and all changes which come within the meaning and range of equivalency of claims are therefore intended to be embraced therein.

What I claim is:

1. Apparatus for maneuvering a boat in small spaces, the boat having a boat hull and bow, the apparatus comprising:

a. a bow starboard side outlet nozzle located in the boat hull above the water line, b. a bow port side outlet nozzle located in the boat hull above the water line, c. an inlet port located in the boat hull below the water line, d. pump means connected between the inlet port and the starboard and port side nozzles; said pump means having at least two rotors so that rotation of said rotors in one direction produces water flow from said inlet port through said starboard side nozzle whereby the boat hull may be shifted toward the port side and rotation of said rotors in the other direction produces water flow from said inlet port through said port side nozzle whereby the boat hull can be directed to the starboard side, e. electric motor means connected to said pump means, said electric motor means producing rotation of said rotors of said pump means when activated in either a clockwise or counterclockwise direction, and f. activation means for activating said electric motor means, said activation means when activated allowing the electric motor means to produce either a counter clockwise rotation of said rotors of said pump means or a clockwise rotation of said rotors of said pump means.

2. The apparatus of claim 1 wherein said rotors include an inner rotor and an outer rotor, said inner rotor and outer rotor having a plenum therebetween for receiving and transmitting water, said inner rotor having teeth around its borders and said outer rotor having indentations adapted to receive the teeth of said inner rotor whereby rotation of said inner rotor causes rotation of said outer rotor in the same direction producing water flow from said inlet port through said plenum and toward the bow starboard side or port side nozzle.

* * * * *